US010544379B2

(12) United States Patent
Fandrich et al.

(10) Patent No.: US 10,544,379 B2
(45) Date of Patent: Jan. 28, 2020

(54) FIRE STARTING DEVICES AND METHODS

(71) Applicant: Live Fire Gear, LLC, Forest Park, IL (US)

(72) Inventors: Roger J. Fandrich, Blue Ridge Summit, PA (US); Dayna Fandrich, Blue Ridge Summit, PA (US); Adam B. Francis, Frederick, MD (US)

(73) Assignee: Live Fire Gear, LLC, Forest Park, IL (US)

( * ) Notice: Subject to any disclaimer, the term of this patent is extended or adjusted under 35 U.S.C. 154(b) by 0 days.

(21) Appl. No.: 15/811,438

(22) Filed: Nov. 13, 2017

(65) Prior Publication Data

US 2018/0100111 A1 Apr. 12, 2018

Related U.S. Application Data

(63) Continuation of application No. 14/632,240, filed on Feb. 26, 2015, now abandoned.

(60) Provisional application No. 61/970,859, filed on Mar. 26, 2014.

(51) Int. Cl.
*C10L 11/04* (2006.01)
*C10L 11/06* (2006.01)

(52) U.S. Cl.
CPC ..... *C10L 11/04* (2013.01); *C10L 11/06* (2013.01); *C10L 2200/043* (2013.01); *C10L 2230/10* (2013.01)

(58) Field of Classification Search
CPC ..... C10L 11/04; C10L 11/06; C10L 5/368; C10L 2200/043; C10L 2200/0453; C10L 2230/06; C10L 2230/10; C10L 2290/58
See application file for complete search history.

(56) References Cited

U.S. PATENT DOCUMENTS

| | | | | |
|---|---|---|---|---|
| 2,737,037 A * | 3/1956 | Zellweger | D07B 5/02 222/3 |
| 2003/0084605 A1* | 5/2003 | Mertz | C10L 11/06 44/519 |
| 2006/0147862 A1* | 7/2006 | Bell | F23D 3/18 431/325 |
| 2012/0021366 A1* | 1/2012 | Moller | C10L 1/02 431/320 |

FOREIGN PATENT DOCUMENTS

| | | | |
|---|---|---|---|
| AT | 163208 B * | 6/1949 | |
| EP | 1375632 A1 * | 1/2004 | C10L 5/363 |

* cited by examiner

*Primary Examiner* — Latosha Hines
(74) *Attorney, Agent, or Firm* — Chicago IP Law; Steven M. Evans

(57) ABSTRACT

Devices and methods are disclosed for creating a fire in normal and adverse conditions using fire starting tinder housed in lightweight containers and multipurpose cords.

11 Claims, 16 Drawing Sheets

FIRE STARTING DEVICES AND METHODS

CROSS-REFERENCE TO RELATED APPLICATIONS

This application is a Continuation Application of application Ser. No. 14/632,240, filed on Feb. 26, 2015, which claims the benefit of U.S. Provisional Patent Application Ser. No. 61/970,859, filed Mar. 26, 2014, and both of the patent applications referenced above in this paragraph are hereby incorporated by reference in their entirety.

BACKGROUND

The ability to start and maintain a fire, especially in the outdoors and under adverse conditions, is often essential to survival. Indeed, the most common cause of death in the wild is hypothermia. Even in hot desert environments, temperatures at night can become frigid and have been known to cause hypothermia and claim lives. Heat generated by a fire can be used to regulate the body's core temperature. In addition to its ability to provide lifesaving thermoregulation in animals and humans, a fire can be used for the following purposes among others: preparing and cooking food, generating smoke for drying and preserving food, sterilizing various materials, disinfecting water, making pottery and implements, providing light, providing protection from insects and predators, and signaling for help.

Typically, a fire is started by placing dry kindling wood or other easily ignitable objects below a stack of wood or another fire sustaining fuel source. However, such easily ignitable objects may be inadequate to ignite wood or other fire sustaining fuel sources. Also, easily ignitable objects may be scarce or incapable of providing sufficient heat or flame to ignite certain fire sustaining fuel sources.

Unfortunately, most people have a tendency to overestimate their ability to create and maintain a fire, especially under adverse conditions such as rain, snow, cold, wind, high altitude, and darkness. Emotional stress and physical injury can also limit a person's ability to create a fire and sustain its existence until help arrives. Even under the best of circumstances, people often do not have the requisite knowledge, skill or ability to create a safe and reliable fire.

Alternative methods and devices for starting fires have been disclosed as means to minimize the effects of adverse environmental conditions, remove the requirement for easily ignitable objects, and simplify fire starting for individuals with little or no experience and basic survival skills. Most alternative methods and devices exploit liquid fuel or solid fuel fire starters. Others provide a small amount of easily ignitable objects that are stored in a weatherproof container until needed. Alternative methods and devices are typically available with instructions for their use in various scenarios.

There remains an unfulfilled need for simple, weather resistant, reusable, adjustable, lightweight, compact, portable, and safe methods and devices for creating sustainable fires in various environments under normal and adverse conditions.

SUMMARY

In addition to fulfilling an unmet need for new starting methods and devices that combine features such as simplicity, weather resistance, reusability, adjustability, prolonged burning, signaling capability, compactness, and safety, we have developed fire starting devices and methods that are versatile. Some of our fire starting devices and methods are particularly multifunctional and can be used for everyday and emergency purposes besides fire starting such as weight bearing, tying, and securing applications.

Accordingly, one embodiment is a fire starter device that includes fire starting tinder made of at least one layer of fabric impregnated with at least one wax and at least one accelerant, and a container surrounding the fire starting tinder. The fabric may be, for example, cotton, wool, a natural fiber, a synthetic fiber, or any combination of cotton, wool, natural fiber, and synthetic fiber. The wax may be, for example, gel wax, paraffin wax, or any combination of gel wax, paraffin wax, and other waxes. The accelerant may be, for example, a hydrocarbon-based fuel (or a petroleum distillate) such as gasoline, diesel fuel, kerosene, turpentine, butane, certain oils and resins, alcohol, common lighter fluids (such as, cigarette lighter fluid, wick type lighter fluid, and charcoal lighter fluid), and various other flammable solvents. The container may be made of any material capable of withstanding burning or heat such as a metal or other natural or synthetic material. In one representative aspect of the embodiment, the lid of the container is attached to the base of the container in such a manner as to permit the lid to slide open and closed thereby exposing more or less of the fire starting tinder inside the base of the container. In the same or other representative aspects of the embodiment, the lid is designed to permit variable amounts of flame to be emitted from the fire starter device so as to provide, for example, a means of controlling heating and lighting (the later for visibility and signaling). In still the same or other representative aspects of the embodiment, at least one dye is added to the fabric impregnated with wax and accelerant. In the same or other representative aspects of the embodiment, at least one oil is added with or without at least one dye to the fabric impregnated with wax and accelerant. The oil and dye of the embodiment may be used, for example, to provide fragrance and color, respectively, to the fire starter device. In some representative aspects of the embodiment, the fire starting tinder includes more than one layer of fabric. The plurality of layers of fabric may be formed from separate sheets of fabric stacked on top of each other. Alternatively, the plurality of layers of fabric may be formed from a single sheet of fabric that is folded one or more times to provide increased height or thickness of the fabric to be placed in the container.

Another embodiment is a fire starter cord that includes an interior core and an exterior sheath. The exterior sheath surrounds the interior core of the cord and may or may not be contiguous along the entire length of the interior core. The exterior sheath may or may not seal the ends of the interior core, and may or may not be joined together at the ends of the cord, so as to form a completely intact cord. The interior core of a representative embodiment includes at least one strand of fire starting tinder that includes fabric impregnated with at least one wax and at least one accelerant, and at least one strand of fiber that is not impregnated with wax and accelerant. The fabric may be, for example, cotton, wool, a natural fiber, a synthetic fiber, or any combination of cotton, wool, natural fiber, and synthetic fiber. The wax may be, for example, gel wax, paraffin wax, or any combination of gel wax, paraffin wax, and other waxes. The accelerant may be, for example, a hydrocarbon-based fuel (or a petroleum distillate) such as gasoline, diesel fuel, kerosene, turpentine, butane, certain oils and resins, alcohol, common lighter fluids (such as, cigarette lighter fluid, wick type lighter fluid, and charcoal lighter fluid), and various other flammable solvents. In the same or other representative aspects of the embodiment, at least one dye is added to the fabric impregnated with wax and accelerant. In the same or other representative aspects of the embodiment, at least one oil is added with or without at least one dye to the fabric impregnated with wax and accelerant. The oil and dye of the embodiment may be used, for example, to provide fragrance and color, respectively, to the fire starter cord. In some representative aspects of the embodiment, there may be included one or more strands of fire starting tinder with or without one or more strands of fiber that are not impregnated with wax and accelerant. It is anticipated that any number and combination of strands of fire starting tinder and strands of fiber that are not impregnated with wax and an accelerant may be included in the fire starting cord. The fiber that is not impregnated with wax and accelerant may be, for example, natural fiber, synthetic fiber, or combinations of natural fiber and synthetic fiber. In the same or other representative embodiments, the interior core provides tensile strength to the fire starter cord. In the same or other representative embodiments, the exterior sheath protects the interior core and optimizes the strength, durability, and flexibility of the fire starter cord. The exterior sheath may include, for example, one or more strands of fiber, and the strands may or may not be interwoven. In one representative embodiment, at least one strand of fire starting tinder is included with the interior core strands of kernmantle rope and the strand or strands of fire starting tinder may or may not be interwoven with the interior core strands of kernmantle rope. In one aspect the kernmantle rope is parachute cord.

Another embodiment is a method of starting a fire using a fire starter device that includes providing a fire starter device (in which the fire starter device includes fire starting tinder that includes at least one layer of fabric impregnated with at least one wax and at least one accelerant, and a container surrounding the fire starting tinder), exposing the microfibers comprising the fire starting tinder, igniting the exposed microfibers of the fire starting tinder, varying the opening of the container to adjust the flame size, and placing the flame from the fire starter device under a pre-prepared fuel source. The accelerant may be, for example, a hydrocarbon-based fuel (or a petroleum distillate) such as gasoline, diesel fuel, kerosene, turpentine, butane, certain oils and resins, alcohol, common lighter fluids (such as, cigarette lighter fluid, wick type lighter fluid, and charcoal lighter fluid), and various other flammable solvents. The pre-prepared fuel source may be, for example, wood or other material capable of sustained burning once ignited.

Another embodiment is a method of starting a fire using a fire starter cord that includes providing a fire starter cord (in which the fire starter cord includes an interior core that includes at least one strand of fire starting tinder including fabric impregnated with at least one wax and at least one accelerant, and at least one strand of fiber that is not impregnated with wax and accelerant, and an exterior sheath), removing a sufficient length of at least one strand of fire starting tinder from the interior core, exposing the microfibers comprising the fire starting tinder, igniting the exposed microfibers of the fire starting tinder, and placing the ignited fire starting tinder under a pre-prepared fuel source. The accelerant may be, for example, a hydrocarbon-based fuel (or a petroleum distillate) such as gasoline, diesel fuel, kerosene, turpentine, butane, certain oils and resins, alcohol, common lighter fluids (such as, cigarette lighter fluid, wick type lighter fluid, and charcoal lighter fluid), and various other flammable solvents. The pre-prepared fuel source may be, for example, wood or another material capable of sustained burning once ignited. The interior core may include a plurality of strands of fire starting tinder including fabric impregnated with at least one wax and at least one accelerant and a plurality of strands of fiber that are not impregnated with wax and accelerant, or any combination of various numbers of strands of fire starting tinder and strands of fiber. At least one strand of fire starting tinder may be included in the exterior sheath of the cord in the absence or presence of at least one strand of fiber that is not impregnated with wax and accelerant.

The foregoing embodiments and aspects are among others achieved in the disclosure.

The present disclosure and representative and alternative embodiments fulfill a long felt need. They overcome major disadvantages and deficiencies of prior art methods and devices by providing simple, weather resistant, reusable, adjustable, lightweight, safe, and multifunctional devices and associated methods for creating sustainable fires in various environments under normal and emergency conditions.

There has thus been outlined, rather broadly, features of the disclosure in order that the detailed description thereof that follows may be better understood, and in order that the present contribution to the art may be better appreciated. There are, of course, additional features of the embodiments of the disclosure that will be described further hereinafter. Indeed, it is to be understood that both the foregoing general description and the following detailed description are exemplary and explanatory and are intended to provide further explanation of the disclosure as claimed.

In this respect, before explaining at least one embodiment in detail, it is to be understood that the disclosure is not limited in its application to the details of construction and to the arrangements of the components set forth in the following description or illustrated in the drawings. The disclosure is capable of other embodiments and of being practiced and carried out in various ways. Also, it is to be understood that the phraseology and terminology employed herein are for the purpose of description and should not be regarded as limiting.

As such, those skilled in the art will appreciate that the conception upon which this disclosure is based may readily be utilized as a basis for the designing of other methods, systems, devices, and compositions for carrying out the several purposes of the present disclosure. It is important, therefore, that equivalent constructions insofar as they do not depart from the spirit and scope of the present disclosure, are included in the present disclosure.

The accompanying drawings are included to provide a further understanding of the disclosure and representative embodiments. The accompanying drawings are incorporated in and constitute a part of this specification, illustrate several embodiments of the disclosure, and together with the description serve to explain the principles of the disclosure.

BRIEF DESCRIPTION OF THE DRAWINGS

FIG. 8A shows the hand of an individual holding a cut portion of a fire starter cord with the interior core exposed and the single strand of fire starting tinder partly separated from the plurality of strands of fiber. FIG. 8B shows the hands of an individual pulling on the single strand of fire starting tinder to further separate it from the plurality of strands of fiber and the exterior sheath of the fire starter cord. FIG. 8C shows the hand of an individual using a knife to scrape the surface of the strand of fire starting tinder and thereby exposing the microfibers of the strand of fire starting tinder. FIG. 8D shows a magnified view of the surface of the strand of fire starting tinder with its exposed microfibers. FIG. 8E illustrates the hands of an individual using a knife and a ferrocerium rod to produce sparks that will ignite the exposed microfibers of the strand of fire starting tinder. FIG. 8F shows an ignited section of the strand of fire starting tinder. FIG. 8G shows the placement of the ignited strand of fire starting tinder beneath a pre-prepared fuel source.

DETAILED DESCRIPTION OF THE EXEMPLARY EMBODIMENTS

Figure 1:
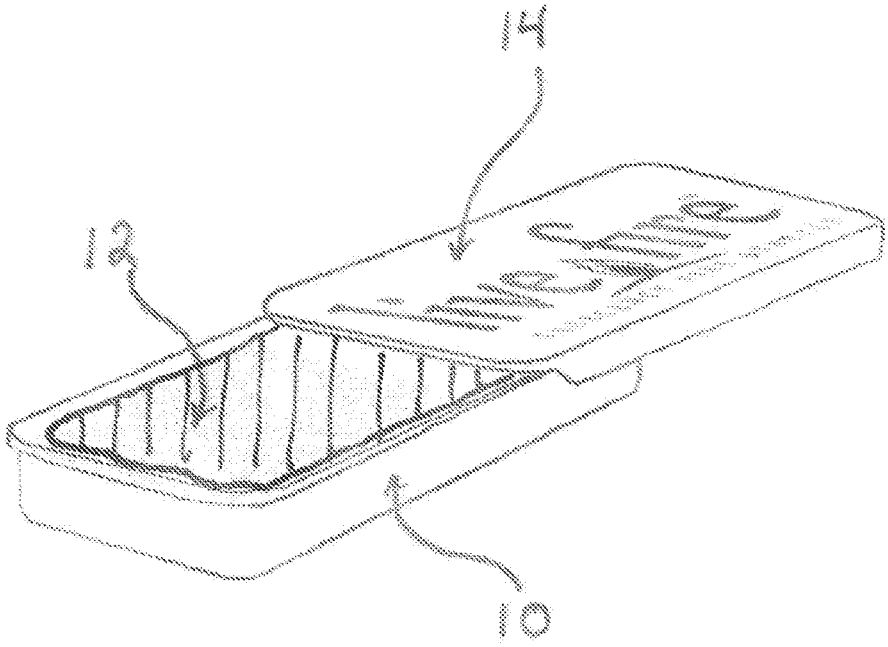
FIG. 1 depicts a fire starter device according to an embodiment of the present disclosure.

Provided herein are devices and methods for building a fire. Reference will now be made in detail to representative embodiments of the disclosure, examples of which are illustrated in the accompanying drawings.

The term "tinder" as used herein means, but is not limited to, easily combustible material used to ignite fires. Typically, a small fire consisting of tinder is used to ignite kindling (which usually consists of small pieces of wood or other combustible material used to build a large fire). However, tinder can also be used directly to build a large fire.

The term "fabric" as used herein has the meaning ascribed to it by a person skilled in the art and means, but is not limited to, natural, woven, non-woven, knitted, netted, and synthetic materials such as cotton, leather, natural fibers, nylon, wool, or the like.

The term "wax" as used herein means, but is not limited to, an organic compound that is malleable near ambient temperatures and may be either synthetic or naturally occurring. Wax is also a type of lipid. Wax characteristically melts above 45 degrees Celsius to give a low viscosity liquid. Wax is insoluble in water but soluble in organic, nonpolar solvents. Wax may be, for example, animal wax, plant/vegetable wax, mineral wax, petroleum-derived wax (for example, paraffin), montan wax, synthetic wax, and polyethylene and related derivatives. In representative embodiments of the present disclosure, paraffin wax is used and may be obtained commercially from several manufacturers. In representative embodiments of the present disclosure, gel wax is also used and may be obtained commercially from several manufacturers. Gel wax, which is also known as candle gel, is manufactured from specially processed mineral oils and gelled with copolymers or polymer resin. It has a transparent rubbery texture and burns twice as long as paraffin.

The term "accelerant" as used herein means, but is not limited to, any substance or mixture that "accelerates" the development of fire. Accelerant may be, for example, a hydrocarbon-based fuel (sometimes referred to as a petroleum distillate) such as gasoline, diesel fuel, kerosene, turpentine, butane, certain oils and resins, alcohol, common lighter fluids (such as, cigarette lighter fluid, wick type lighter fluid, and charcoal lighter fluid), and various other flammable solvents.

The term "fiber" as used herein has the meaning ascribed to it by a person skilled in the art and means, but is not limited to, a rope or string used as a component of composite materials. Fiber may be, for example, textile fiber, natural fiber, semi-synthetic fiber, synthetic fiber (for example, nylon and dacron), cellulose-regenerated fiber (for example, rayon), microfiber, fiberglass, metallic fiber, carbon fiber, polymer fiber, or the like.

The term "dye" as used herein means, but is not limited to, a colored substance that has an affinity to the substrate to which it is being applied. Dye may be, for example, natural dye, synthetic dye, food dye, leather dye, fluorescent brightener, solvent dye, carbene dye, or the like.

The term "oil" as used herein means, but is not limited to, any neutral, nonpolar chemical substance that is a viscous liquid at ambient temperatures and is both hydrophobic and lipophilic. Oil may be, for example, organic oil, mineral oil, petrochemical, volatile or non-volatile, used for fragrance, used for fuel, or the like.

The term "fuel source" as used herein means, but is not limited to, material that stores potential energy in forms that can be practicably released and used as heat energy. Fuel source may be, for example, a solid material that is used as fuel to produce energy and provide heating, usually released through combustion. Solid fuels include, for example, wood, charcoal, peat, coal, grains, or the like.

The term "impregnate" or "impregnated" as used herein means, but is not limited to, the process of saturating, soaking, filling, permeating, infusing, or imbuing a material with something.

The term "kernmantle rope" as used herein means, but is not limited to, rope constructed with its interior core protected by a woven exterior sheath designed to optimize strength, durability, and flexibility. The core fibers provide the tensile strength of the rope, while the sheath protects the core from abrasion during use.

The term "parachute cord" as used herein means, but is not limited to, a lightweight nylon kernmantle rope originally used in the suspension lines of parachutes. The braided sheath has a high number of interwoven strands for its size, giving it a relatively smooth texture. The all-nylon construction makes parachute cord fairly elastic. Parachute cord may be, for example, paracord or 550 cord when referring to type-III paracord, or the like.

The following examples are provided for illustration purposes only, and are in no way intended to limit the scope of the present disclosure.

EXAMPLE 1

Fire Starting Tinder in a Re-Sealable Container

Overview

FIG. 1 shows one embodiment of a fire starter device of the present disclosure, which includes fire starting tinder 12 in a container comprising lid 14 slidably attached to container base 10. A person skilled in the art will understand that the container may be, for example, a sheet metal container as depicted. The size of the container may be selected based on several factors including portability and, as shown, may be a tin container with rectangular dimensions of, for example, 1.9"×0.908"×0.375" or 3.125"×1.375"×0.375", which are commercially available from several manufacturers such as All State Can Co.

Figure 2A:
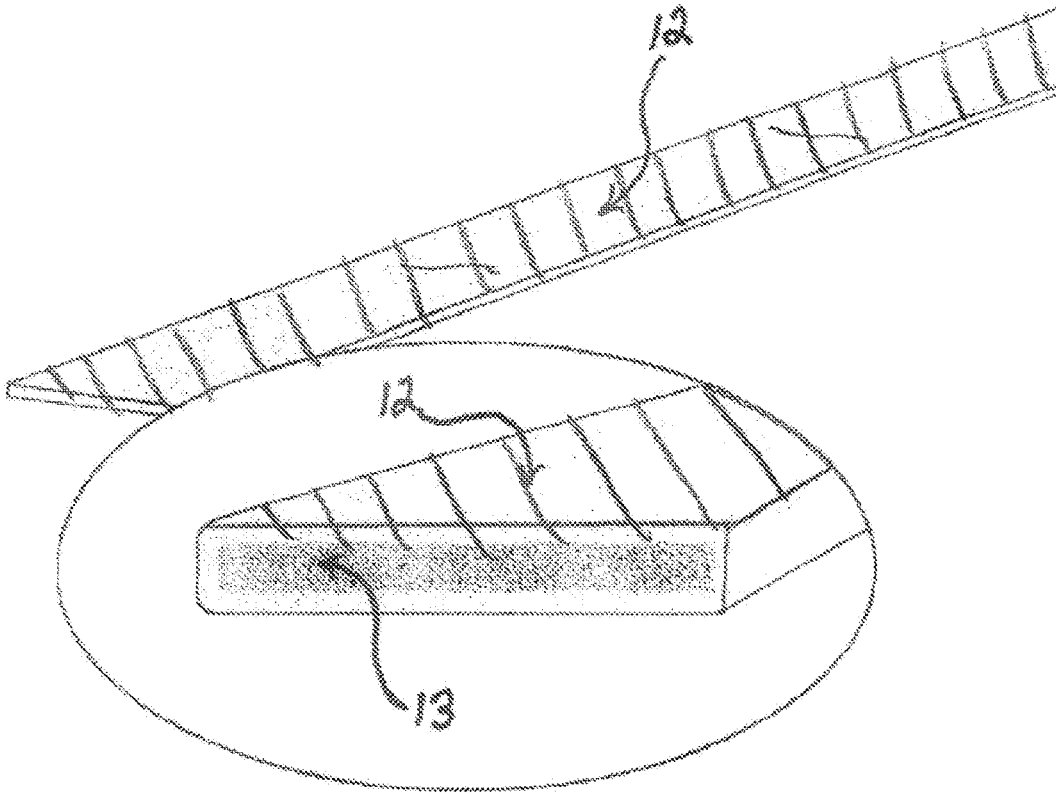
FIG. 2A shows a cross-section of the fire starting tinder of a fire starter device according to an embodiment of the present disclosure.
Figure 2B:
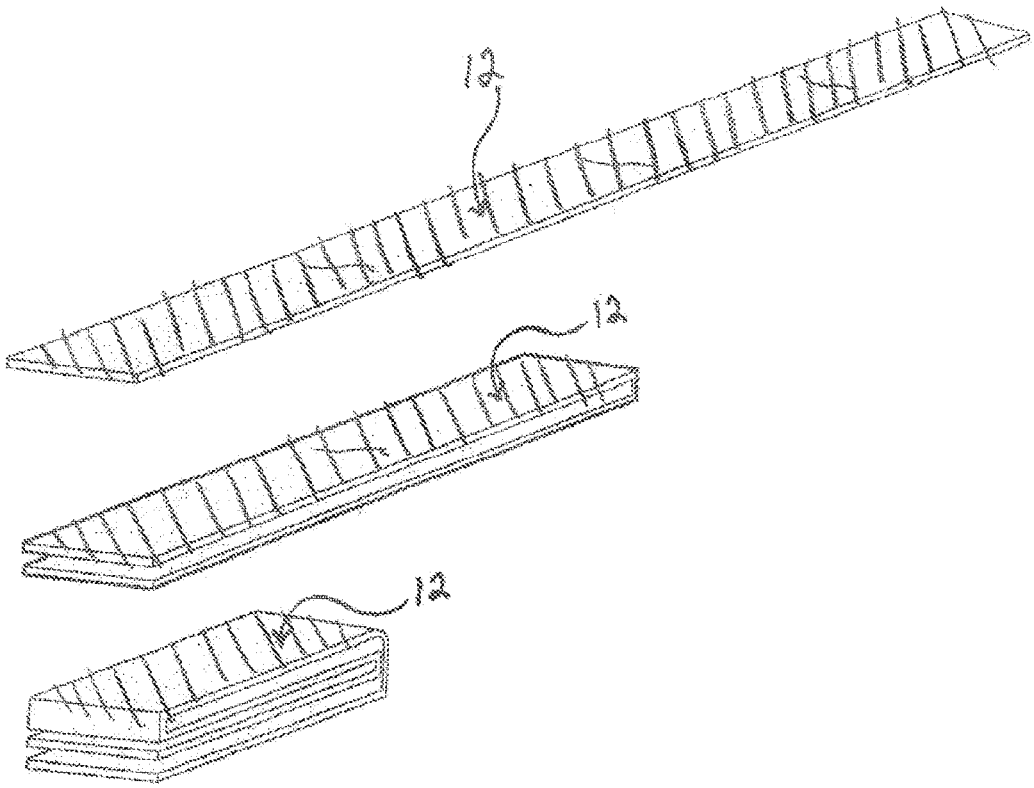
FIG. 2B shows the folding process used to prepare the fire starting tinder to be placed into the container of a fire starter device according to an embodiment of the present disclosure.
Figure 3:
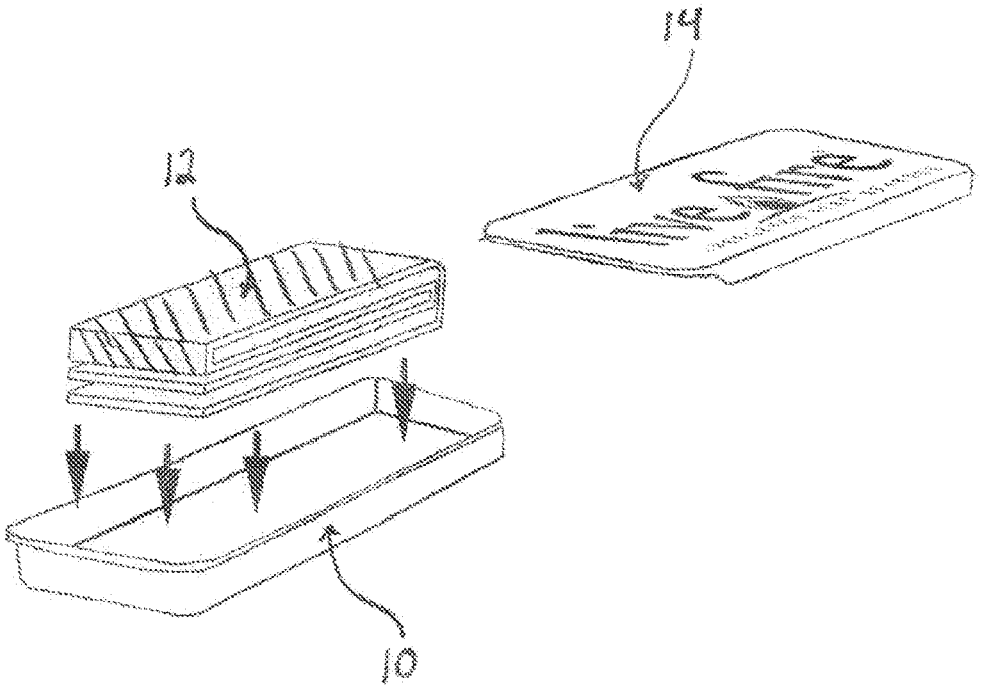
FIG. 3 shows an exploded view of a folded piece of fire starting tinder being placed into the container of a fire starter device according to an embodiment of the present disclosure.

Fire starting tinder 12 comprises at least one layer of fabric impregnated with mixture 13 comprising at least one wax and at least one accelerant (FIG. 2A). In one embodiment, mixture 13 comprises paraffin wax, gel wax, kerosene, fragrance oil, and candle dye. As described further below according to a method of making an embodiment of a fire starter device, fire starting tinder 12 is folded in half lengthwise several times to form a stack of fire starting tinder 12 (FIG. 2B) capable of fitting snugly inside container base 10 (FIG. 3).

Figure 4:
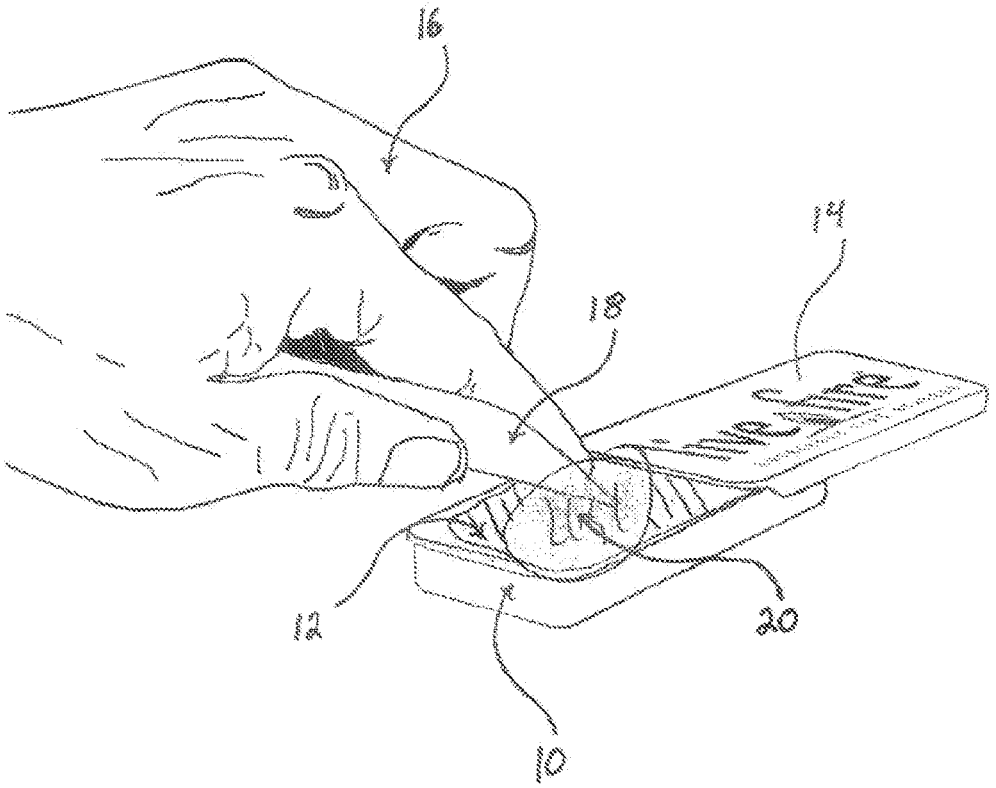
FIG. 4 illustrates the hand of an individual using a knife to scrape the surface of the fire starting tinder and thereby exposing the microfibers of the fire starting tinder of a fire starter device according to an embodiment of the present disclosure.
Figure 5:
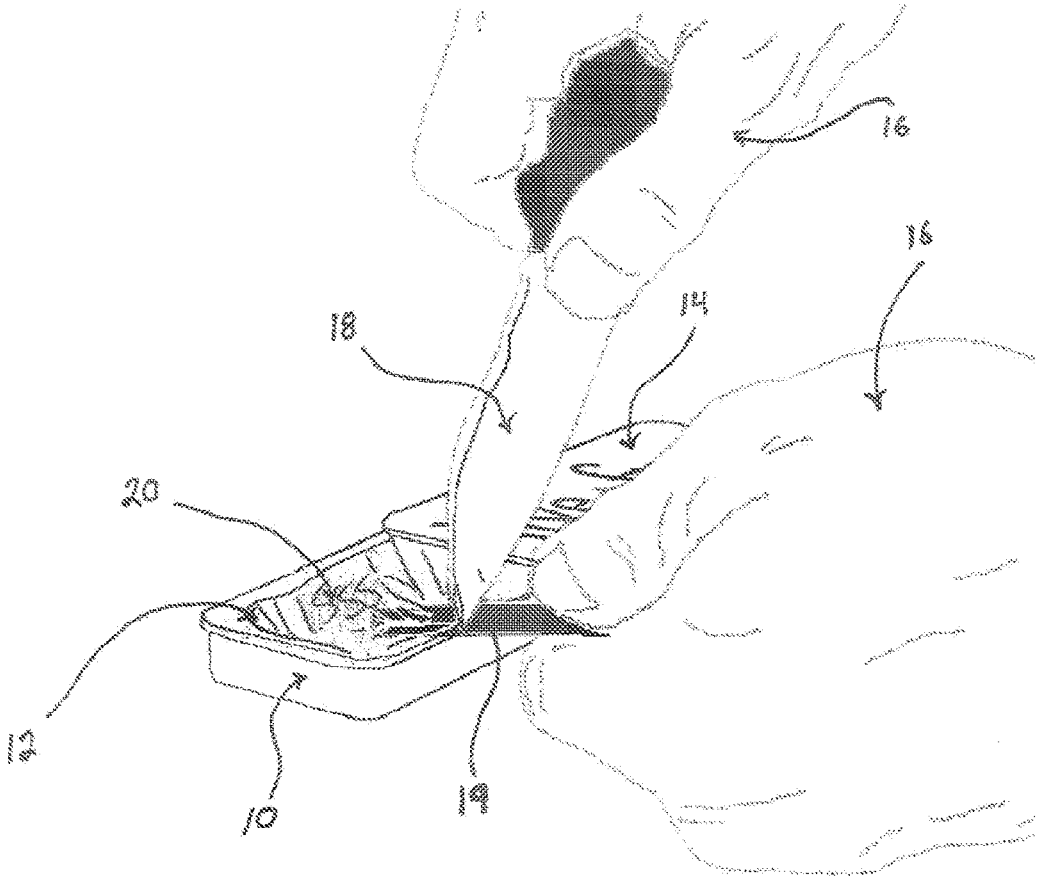
FIG. 5 illustrates the hands of an individual using a knife and a ferrocerium rod to produce sparks that will ignite the exposed microfibers of the fire starting tinder of a fire starter device according to an embodiment of the present disclosure.
Figure 6:
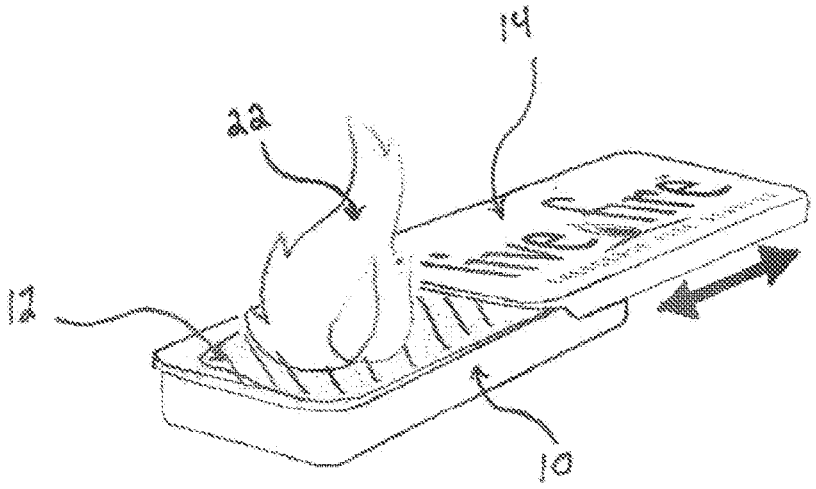
FIG. 6 shows an ignited section of the fire starting tinder of a fire starter device and the slidably attached lid of the container being used to regulate the amount of flame being emitted from a fire starter device according to an embodiment of the present disclosure.

To use the fire starter device of one embodiment of the disclosure, knife 18 is drawn by hand 16 across fire starting tinder 12 one or more times to expose portion 20 of fire starting tinder 12 (FIG. 4). A person skilled in the art will understand that another suitable device may be substituted for knife 18 for the purpose described here, and that the purpose is to expose portion 20 (microfibers comprising fire starting tinder 12) by scraping, scratching, cutting, ripping, tearing, and the like. FIG. 5 shows one hand 16 holding rod 19 near exposed portion 20 and another hand 16 holding knife 18 and striking rod 19 with knife 18 so as to create and direct sparks toward exposed portion 20 in order to ignite fire starting tinder 12. In one embodiment of the disclosure, rod 19 is a ferrocerium rod. A person skilled in the art will understand that other suitable devices (and methods) may be substituted for knife 18 and rod 19 for the purpose of generating sparks capable of igniting exposed portion 20. A person desiring to use the fire starter device for alternative purposes may ignite exposed portion 20 with a direct source of heat or flame. FIG. 6 illustrates flame 22 arising from exposed portion 20 of fire starting tinder 12, and depicts lid 19 sliding lengthwise on container base 10 so as to regulate the amount of flame 22 capable of being emitted from the fire starter device of one embodiment of the disclosure.

It is understood that the fire starter device of one embodiment of the disclosure may be used alone for various purposes or used to ignite a pre-prepared fuel source. Once a sustainable fire has been achieved following ignition of a pre-prepared fuel source, the fire starter device may be removed and flame 22 extinguished using lid 14. It is further understood that the fire starter device may be used more than once and that lid 19 permits, for example, resealing of the container for storage of non-ignited fire starting tinder 12, varying heat, light, and smoke emission, and varying burn time.

Manufacturing Process for a Representative Fire Starter Device

Always wear protective gear such as gloves and a respirator when manufacturing the fire starter devices according to this disclosure.

A sheet of fabric (for example, 100% cotton) is saturated with a complex mixture of waxes, dyes, accelerants, and fragrance oils according to the formulations set forth in Table 1. The resulting component is fire starting tinder 12, which is semisolid, flexible, waterproof, and compact.

In one embodiment, a sheet of cotton fabric measures 13"×21" and can be cut into 4,320 equal size rectangular strips. In another embodiment, a sheet of cotton fabric measures 6.5"×21" and can be cut into 8,640 equal size rectangular strips. Sheets are cut into several rectangular sheets using a roller cutting blade on a solid surface and then set aside until after preparation of the mixture of waxes, dyes, accelerants, and fragrance oils.

Place a large cooking pot on an electric stove and set the temperature control to "high." Referring to Table 1, immediately add the desired amount of paraffin wax into the cooking pot. Then, immediately place the desired amount of gel wax into the cooking pot. Stir in the desired amount of fragrance oil. Lastly, stir in the desired amount of candle dye. A person skilled in the art will understand that various dyes may be added (such as, reds, yellows, blues, among other colors, and combinations thereof) as well as various fragrances (such as, cedar among others and combinations thereof).

TABLE 1

Representative formulations of fire starting tinder used in fire starter devices comprising re-sealable containers.

| | 13" × 21" Sheet (4320 strips) | | 6.5" × 21" Sheet (8640 strips) | |
|---|---|---|---|---|
| Material | Range | Optimal | Range | Optimal |
| Cotton Fabric Sheets | 0-500 units | 240 units | 0-700 units | 480 units |
| Paraffin Wax | 1281-1653 ounces | 1408 ounces | 1281-1653 ounces | 1408 ounces |
| Gel Wax | 111-287 ounces | 132 ounces | 111-287 ounces | 132 ounces |
| Kerosene | 247-444 ounces | 352 ounces | 247-444 ounces | 352 ounces |
| Cedar Fragrance Oil | 0-200 ounces | 88 ounces | 0-200 ounces | 88 ounces |
| Yellow Candle Dye | 0-200 ounces | 24 ounces | 0-200 ounces | 24 ounces |

Reduce the temperature on the stove as necessary to avoid boiling the mixture. Continue stirring until the paraffin wax and gel wax are molten and well mixed into a thick liquid formulation. Remove the cooking pot from the stove and let the mixture cool for approximately five minutes.

Referring to Table 1, slowly add with stirring the desired amount of accelerant (for example, kerosene) until the mixture appears homogeneous.

Quickly submerge the rectangular sheets in the molten mixture. Using a set of tongs, gently remove the rectangular sheets and temporarily place them in piles on a flat surface. Allow the sheets to cool for approximately one minute before handling them with fingers. Gently pick up, and then lay flat, one sheet at a time on baking pans or other suitable surfaces. Do not stack the sheets.

Let the sheets cool for approximately fifteen minutes or until slightly warm to the touch. Fold each sheet in half, lengthwise, and then stack on top of each other. Let cool for approximately twenty minutes.

Using a pinking machine with a guide, carefully cut strips from the saturated sheets. In representative embodiments, the strips (fire starting tinder 12) measure 1.1875"×12.25" and 1"×7.5". A person skilled in the art will understand that various sizes of fire starting tinder 12 may be manufactured and added to various sizes of containers.

Fold each strip (fire starting tinder 12) in half. Fold in half again to produce a four-layer strip of fire starting tinder 12. Place fire starting tinder 12 into container base 10. Place lid 14 onto container base 10.

EXAMPLE 2

Fire Starting Tinder in a Multipurpose Cord

Overview

Figure 7A:
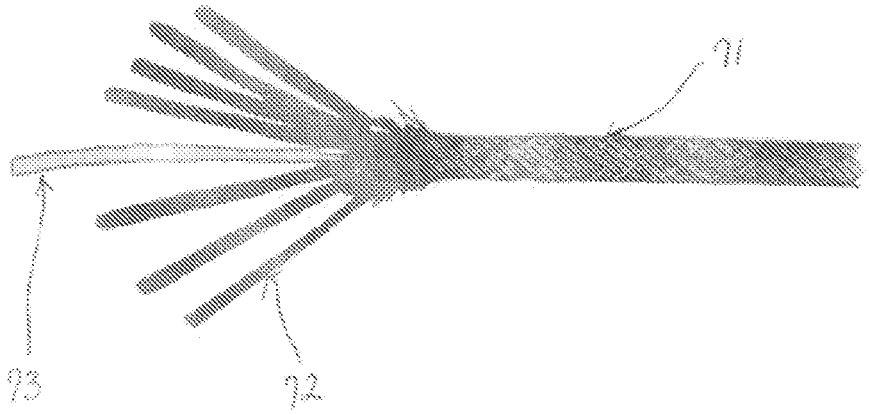
FIG. 7A shows the exterior sheath, a plurality of strands of fiber comprising the interior core, and a single strand of fire starting tinder comprising the interior core of a fire starter cord according to an embodiment of the present disclosure.

FIG. 7A shows one embodiment of a fire starter cord of the present disclosure, which comprises fire starting tinder 73, a plurality of strands of fiber 72, and an exterior sheath 71. A person skilled in the art will understand that fire starting tinder 73 and the plurality of strands of fiber 72 comprise the interior core of the fire starter cord according to one embodiment of the disclosure; and fire starting tinder 73 and the plurality of strands of fiber 72 may be arranged inside exterior sheath 71 in any configuration including, for example, intertwined. In representative embodiments, fire starting tinder 73 may be thicker, thinner, or a different color than the plurality of strands of fiber 72. In alternative embodiments, fire starter cord may comprise one or more strands of fire starting tinder 73 and no or one or more strands of fiber 72, and combinations thereof. As described further below according to a method of making an embodiment of fire starter cord, one strand of fire starting tinder 73 is inserted loosely among seven strands of fiber 72 in exterior sheath 71 during the typical factory processes of cord manufacture and assembly.

Figure 7B:
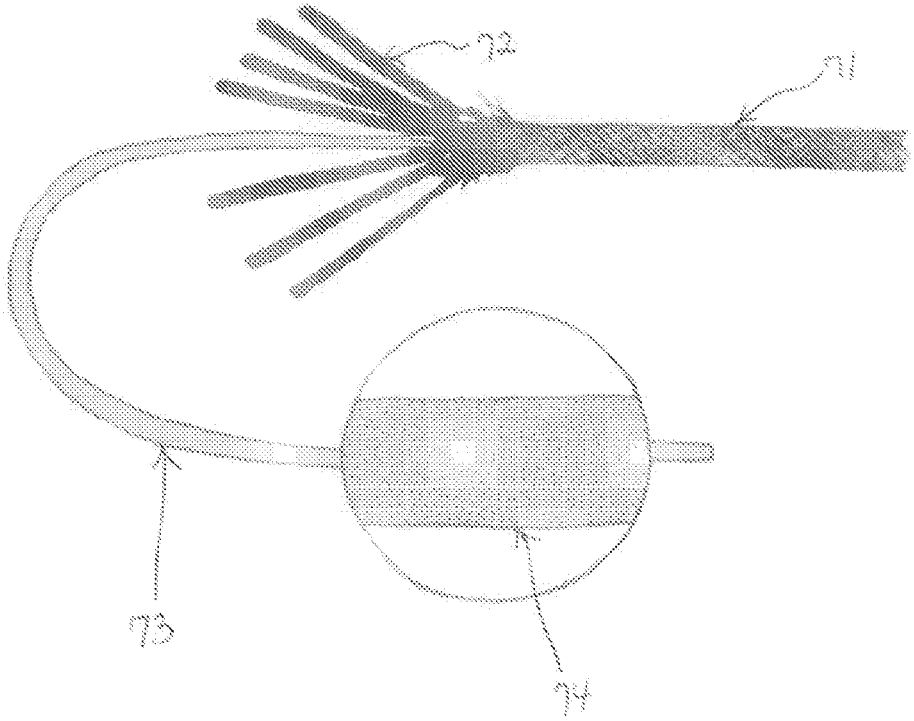
FIG. 7B shows the exterior sheath, a plurality of strands of fiber comprising the interior core, a single strand of fire starting tinder comprising the interior core, and a magnified view of the single strand of fire starting tinder comprising the interior core of a fire starter cord according to an embodiment of the present disclosure.

Fire starting tinder 73 comprises at least one strand of yarn impregnated with mixture 74 comprising at least one wax and at least one accelerant (FIG. 7B). In one embodiment, mixture 74 comprises paraffin wax, gel wax, kerosene, fragrance oil, and candle dye.

Figure 8A:
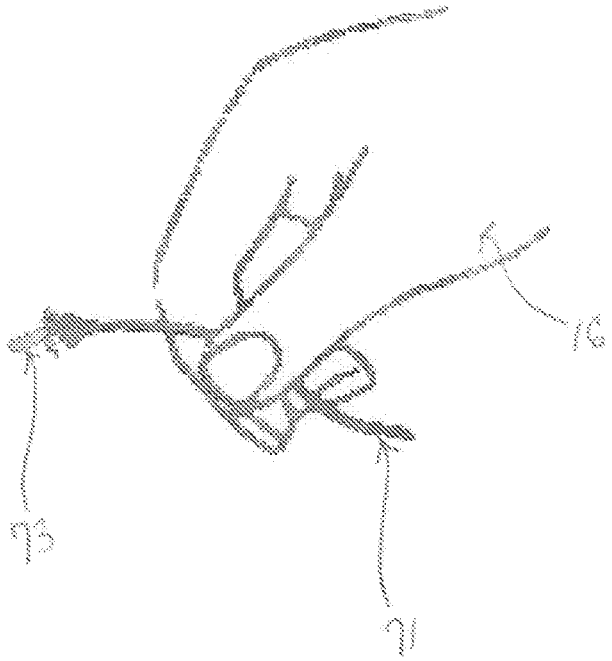
FIG. 8A, FIG. 8B, FIG. 8C, FIG. 8D, FIG. 8E, FIG. 8F, and FIG. 8G illustrate a fire starter cord and the steps involved in using a fire starter cord according to an embodiment of the present disclosure.
Figure 8B:
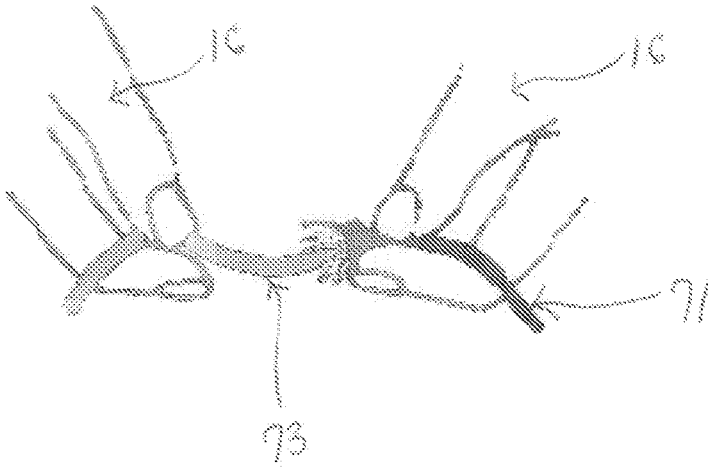
Figure 8C:
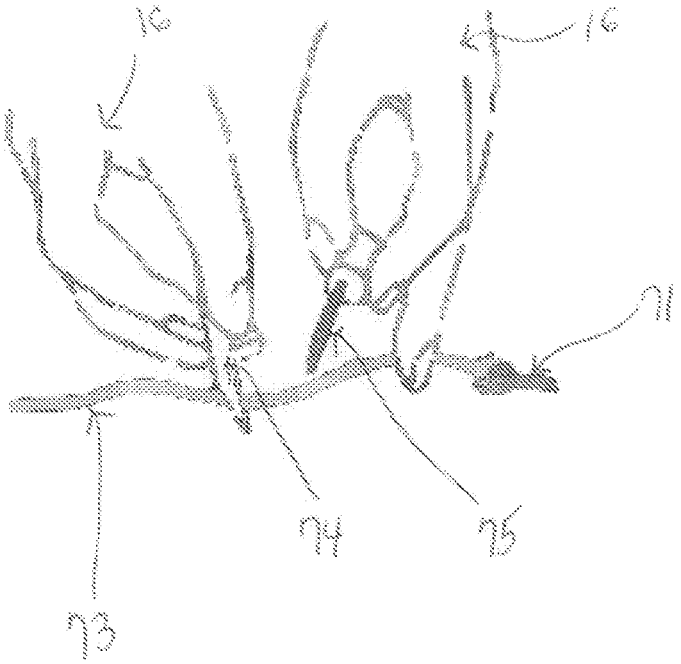
Figure 8D:
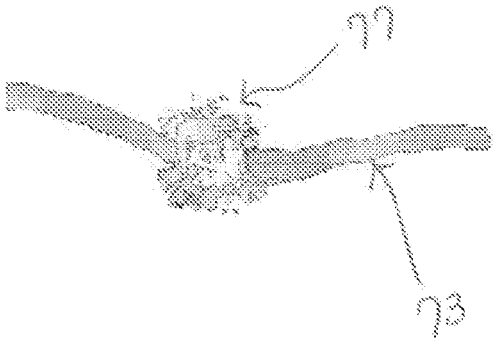
Figure 8E:
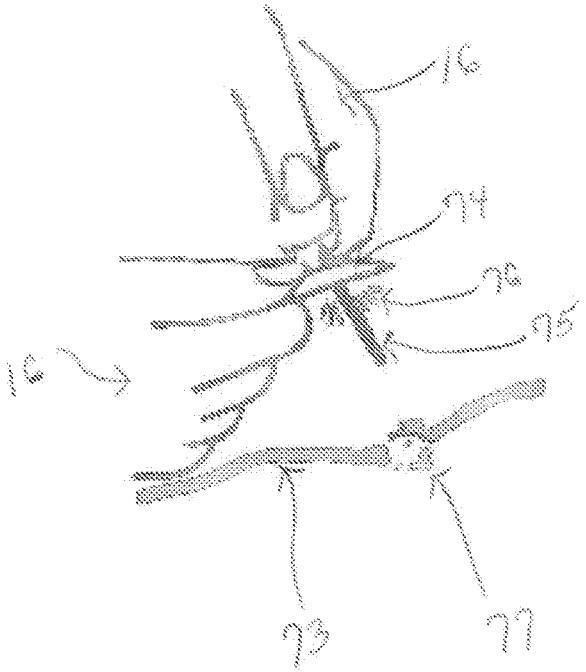
Figure 8F:
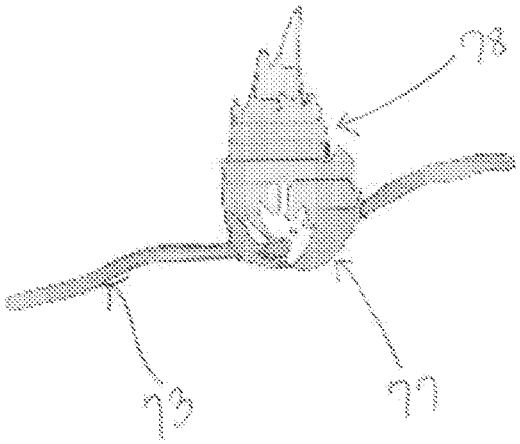
Figure 8G:
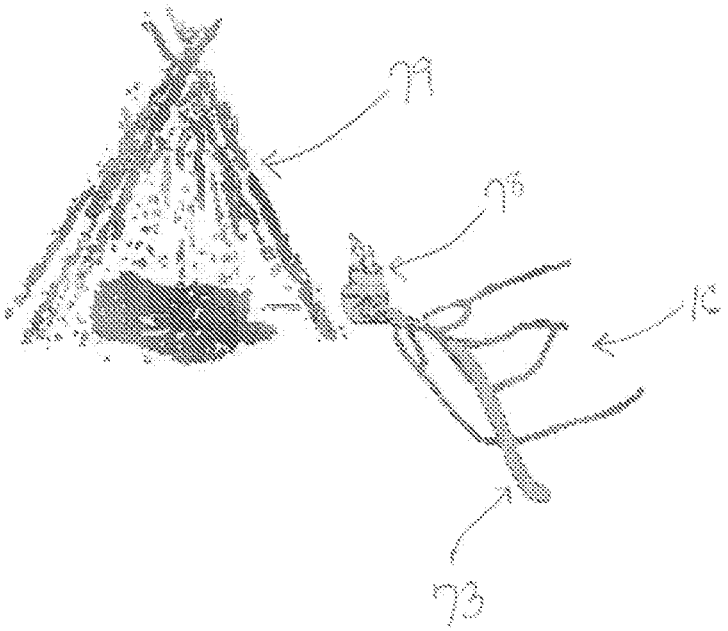

To use the fire starter cord of one embodiment of the disclosure, a person holds exterior sheath 71 of the cord in one hand 16 after exposing fire starting tinder 73 from exterior sheath 71 (FIG. 8A). A suitable length of fire starting tinder 73 is drawn by hand 16 from exterior sheath 71 (FIG. 8B). A person skilled in the art will understand that a suitable length of fire starting tinder 73 is determined empirically to achieve the amount of flame, heat, and burn time necessary for the particular purpose for which the fire starter cord is employed. Similarly, a person skilled in the art will understand that exposed fire starting tinder 73 may remain contiguous with unexposed fire starting tinder 73 inside exterior sheath 71 or cut and removed from the remaining intact cord. As shown in FIG. 8C and FIG. 8D, knife 74 is drawn by hand 16 across fire starting tinder 73 one or more times to expose portion 77 (microfibers) of fire starting tinder 73. A person skilled in the art will understand that another suitable device may be substituted for knife 74 for the purpose described here, and that the purpose is to expose portion 77 by scraping, scratching, cutting, ripping, tearing, and the like, with or without (as shown in the figure) severing fire starting tinder 73 (FIG. 8D). FIG. 8E shows one hand 16 holding rod 75 near exposed portion 77 and another hand 16 holding knife 74 and striking rod 75 with knife 74 so as to create and direct sparks 76 toward exposed portion 77 in order to ignite fire starting tinder 73. In one embodiment of the disclosure, rod 75 is a ferrocerium rod. A person skilled in the art will understand that other suitable devices (and methods) may be substituted for knife 74 and rod 75 for the purpose of generating sparks 76 capable of igniting exposed portion 77. A person desiring to use the fire starter cord for alternative purposes may ignite exposed portion 77 with a direct source of heat or flame. FIG. 8F illustrates flame 78 arising from exposed portion 77 of fire starting tinder 73. It is understood that the fire starter cord of one embodiment of the disclosure may be used alone for various purposes or used to ignite pre-prepared fuel source 79 (FIG. 8G).

Manufacturing Process for a Representative Fire Starter Cord

Always wear protective gear such as gloves and a respirator when manufacturing the fire starter cords according to this disclosure.

A cone of yarn (for example, 100% cotton) is saturated with a complex mixture of waxes, dyes, accelerants, and fragrance oils according to the formulations set forth in Table 2. The resulting component is fire starting tinder 73, which is flexible and waterproof. In one embodiment, one cone of yarn equals 2,100 linear feet.

TABLE 2

Representative formulations of fire starting tinder used in multipurpose fire starter cords.

| Material | Range | Optimal |
|---|---|---|
| Cotton Yarn Cones | 15-75 units | 44 units |
| Paraffin Wax | 1351-1449 ounces | 1408 ounces |
| Gel Wax | 111-285 ounces | 132 ounces |
| Kerosene | 313-443 ounces | 352 ounces |
| Cedar Fragrance Oil | 0-200 ounces | 88 ounces |
| Red Candle Dye | 0-200 ounces | 24 ounces |

According to one embodiment (see Table 2), place 1,408 ounces of paraffin wax, 132 ounces of gel wax, 352 ounces of kerosene, optionally 88 ounces of cedar fragrance oil, and optionally 24 ounces of red candle dye into a 150 gallon melting chamber (for example, Honey Bottler & Beeswax Melter 150, Melting and Filling Equipment, Inc., www.waxmelters.com). A person skilled in the art will understand that various fragrances (such as, cedar among others and combinations thereof) as well as various dyes may be added (such as, reds, yellows, blues, among other colors, and combinations thereof).

The components are melted and mixed in the melting chamber at a temperature not exceeding 215 degrees Fahrenheit.

Once completely melted and mixed, the mixture is transferred to a six-chamber dipping tank (for example, Dipping Tank-6 Chamber Unit, Melting and Filling Equipment, Inc., www.waxmelters.com). Each of the six chambers of the dipping tank is filled to the two-thirds fill mark.

Place three cones of yarn into each of the six chambers of the dipping tank.

Keep each cone of yarn submerged in the dipping tank for no less than fifteen minutes and no more than seventeen minutes to permit complete saturation of the yarn with the mixture of waxes, dyes, accelerants, and fragrance oils.

Remove each cone of yarn (now consisting of, for example, fire starting tinder 73), from the dipping chamber and allow to drain and cool. Store cones in plastic bags until final assembly and manufacturing of fire starter cord (such as by a commercial rope braiding company).

A person skilled in the art will understand that various configurations of fire starter cord may be assembled and manufactured according to representative embodiments of the present disclosure. For example, fire starter cord may comprise one or more strands of fire starting tinder alone or together with one or more strands of fiber surrounded by an exterior sheath. The diameters of the strands of fire starting tinder and strands of fiber may vary based on the multiple purposes for which the fire starter cord may be used including but not limited to fire starting, weight bearing applications, and tying or securing functions.

Each reference referred to within this disclosure is hereby incorporated in its respective entirety.

Having now described a few exemplary embodiments of the disclosure, it should be apparent to those skilled in the art that the foregoing is merely illustrative and not limiting, having been presented by way of example only. Numerous modifications and other embodiments are within the scope of one of ordinary skill in the art and are contemplated as falling within the scope of the disclosure and any equivalent thereto. It can be appreciated that variations to the present disclosure would be readily apparent to those skilled in the art, and the present disclosure is intended to include those alternatives. Further, because numerous modifications will readily occur to those skilled in the art, it is not desired to limit the disclosure to the exact construction and operation illustrated and described, and accordingly, all suitable modifications and equivalents may be resorted to, falling within the scope of the disclosure.

We claim:

1. A fire starter cord, comprising:

a first strand of fire starting tinder fabric impregnated with kerosene fuel and gel wax that function as accelerants;

a second strand of fiber that is accelerant-free and wax-free extending adjacent to the first strand of fire starting tinder fabric; and a fiber sheath surrounding both the first strand of fire starting tinder fabric and the second strand of fiber.

2. The fire starter cord of claim 1, wherein the first strand of fire starting tinder fabric is constructed of a group consisting of cotton, wool, natural fiber, synthetic fiber, and combinations thereof.

3. The fire starter cord of claim 1, further comprising:

additional strands of fiber that are accelerant-free and wax-free extending adjacent to the first strand of fire starting tinder fabric.

4. The fire starter cord of claim 1, the first strand of fire starting tinder fabric further comprising paraffin wax.

5. The fire starter cord of claim 1, wherein the second strand of fiber is selected from the group consisting of natural fiber, synthetic fiber, and combinations thereof.

6. The fire starter cord of claim 1, wherein the second strand of fiber is constructed of nylon.

7. The fire starter cord of claim 1, wherein the first strand of fire starting tinder fabric is constructed of cotton and is further impregnated with paraffin wax, candle dye, and fragrance oil, and;

further comprising additional strands of nylon that are wax-free and accelerant-free.

8. The fire starter cord of claim 1, wherein the fiber sheath is constructed of nylon, thereby providing a smooth outer surface and added tensile strength.

9. The fire starter cord of claim 1, wherein the first strand of fire starting tinder fabric is constructed of nylon.

10. The fire starter cord of claim 1, wherein the fiber sheath is constructed of nylon.

11. The fire starter cord of claim 1, wherein the fiber sheath is constructed of material that is accelerant-free and wax-free.

* * * * *